US008093997B2

(12) United States Patent
White

(10) Patent No.: US 8,093,997 B2
(45) Date of Patent: Jan. 10, 2012

(54) SYSTEM AND APPARATUS FOR SILENT PULSATING COMMUNICATIONS

(76) Inventor: Isaac Olney White, Wyman Township, ME (US)

( * ) Notice: Subject to any disclaimer, the term of this patent is extended or adjusted under 35 U.S.C. 154(b) by 382 days.

(21) Appl. No.: 12/409,027

(22) Filed: Mar. 23, 2009

(65) Prior Publication Data

US 2010/0238005 A1 Sep. 23, 2010

(51) Int. Cl.
*G08B 6/00* (2006.01)

(52) U.S. Cl. ..... 340/407.2; 340/7.6; 340/825.19

(58) Field of Classification Search ..... 340/407.2, 340/407.1, 4.12, 7.6, 7.58, 7.2, 6.1, 825.19
See application file for complete search history.

(56) References Cited

U.S. PATENT DOCUMENTS

| | | | | |
|---|---|---|---|---|
| 4,905,001 | A | 2/1990 | Penner | |
| 4,982,432 | A * | 1/1991 | Clark et al. | 704/271 |
| 5,486,112 | A * | 1/1996 | Troudet et al. | 434/250 |
| 5,719,561 | A | 2/1998 | Gonzales | |
| 6,044,153 | A * | 3/2000 | Kaschke | 379/433.01 |
| 6,141,643 | A | 10/2000 | Harmon | |
| 6,230,135 | B1 * | 5/2001 | Ramsay et al. | 704/271 |
| 6,326,901 | B1 | 12/2001 | Gonzales | |
| 6,930,590 | B2 | 8/2005 | Ling et al. | |
| 7,012,593 | B2 * | 3/2006 | Yoon et al. | 345/156 |
| 7,042,438 | B2 * | 5/2006 | McRae et al. | 345/156 |
| 7,046,151 | B2 | 5/2006 | Dundon | |
| 7,098,776 | B2 * | 8/2006 | Chang et al. | 340/407.1 |
| 7,164,348 | B2 | 1/2007 | Smith | |
| 7,271,707 | B2 * | 9/2007 | Gonzales | 340/407.1 |
| 7,696,860 | B2 * | 4/2010 | Gilson et al. | 340/407.1 |
| 2004/0184354 | A1 * | 9/2004 | McDonald | 368/3 |

* cited by examiner

*Primary Examiner* — Daniel Previl
(74) *Attorney, Agent, or Firm* — Dennis R. Haszko

(57) ABSTRACT

A system and apparatus for wireless communications directly between a sender and a receiver using a sending unit and a receiving unit. The sending unit is formed as a glove having a pulse triggering mechanism. The glove is wearable by a user who is the source of a communications signal. The pulse triggering mechanism is motion activated by a finger tip to trigger an electrical signal transmitted wirelessly to the receiving unit. The receiving unit is in the form of a patch worn by a user that receives a tactile message for silent communications.

9 Claims, 3 Drawing Sheets

SYSTEM AND APPARATUS FOR SILENT PULSATING COMMUNICATIONS

FIELD OF THE INVENTION

The present invention relates generally to the field of personal communications. More particularly, the present invention relates to wireless communications directly between a sender and a receiver using a silent pulsating device.

BACKGROUND OF THE INVENTION

In the field of personal communications there exist numerous mechanisms for one individual to communicate with another individual. However, silent communications between individuals is typically limited to hand gestures and systems such as American Sign Language (ASL). Although "signing" between individuals is useful for silent communication purposes, it is difficult to accomplish such communications over any great distance. Moreover, communications over any significant distance or under cover of darkness renders typical signing mechanisms inoperable.

Pulsating radio devices such as vibrating pagers can overcome some of the deficiencies of silent personal communications across great distances. While most such vibrating pagers are often limited to one-way communications, other pulsating radio devices do exist that include two-way communications for discreet messaging.

For example, U.S. Pat. No. 7,164,348 issued to Smith discloses an inconspicuous tactile notification for speaking engagements. The Smith device is intended for use during multimedia presentations at business meetings and conferences where presenters often wish to be free to move about during their presentation. As well, moderators at a presentation or conference can use the Smith device to communicate with the presenters as an alternative to podium lights, buzzers, or other obtrusive signals. The Smith device employs remote-controlled tactile notification rather than sight or sound. The moderator may inform the presenter that the allotted time has expired or numerous other messages may be signaled whereby a predetermined message or code is sent to the presenter by stimulating the presenter's sense of touch.

Another such discreet device is U.S. Pat. No. 7,098,776 issued to Chang et al. which discloses a method and apparatus for vibrotactile (i.e., touch-and-vibration) communication. The Chang et al. device is designed for enhancing interpersonal communication over distance through use of touch. A vibrotactile interface is used to improve remote communication by allowing tactile cues to augment the audio-visual information in real-time. In the Chang et al. device, the pressure exerted by each finger of the transmitter produces patterns of vibration against the corresponding finger of the receiver. A hand-held device using the interface allows a user to transmit and receive patterns of vibration to and from a remote user and signify tactile gestures, or expressive uses of touch.

The touch-and-vibration concept has been the subject of a variety of devices designed for generation of tactile actuators.

One such tactile actuator can be found in U.S. Pat. No. 6,930,590 issued to Ling et al. which discloses a modular electrotactile system and method for delivering tactile stimuli to a skin surface of a user. The system includes one or more electrotactile module each including an array of electrodes electrically connected to an integrated circuit. Each integrated circuit has data processing and current driving capability. The current delivered from the integrated circuit to each electrode is relatively small, preferably less than 4 milliamps. The modules may be connected to a flexible PC board by spring-loaded connectors. In one embodiment a plurality of electrotactile modules may be grouped together to form an electrotactile device. Multiple electrotactile devices may in turn be deployed as part of a wearable article for use in virtual reality, telepresence, telerrobotics or other haptic feedback applications. The system is capable receiving and transmitting tactile data via a communication link, such as a conventional data network. For example, tactile data can be transmitted in a scalable streaming format from a remote site to the system via a data network. The system may form part of a virtual reality entertainment application.

Alternative tactile actuators are also found in U.S. Pat. Nos. 5,719,561, 6,326,901, and 7,271,707 each issued to Gonzales disclose a tactile communication devices for use in tactile communications adaptable for use by anyone able to recognize messages written in a language known to them. The devises use a series of sequentially firing vibromechanical stimulators vibrating against the skin or other suitably tactile sensitive area of the wearer. The vibromechanical stimulators are arrange in a substantially two dimensional array over the skin and are then triggered individually and in sequence, following a set of patterns representative of the symbols in the language recognizable to the wearer to tactually convey the message. The wearer cognitively perceives the tactual stimulation as a line or lines drawn on the skin or suitably tactile sensitive area that resemble the symbols used to communicate between the message sender and the wearer.

Oftentimes, any given tactile actuator can be found in the context of a manually operated device.

One such device is U.S. Pat. No. 4,905,001 issued to Penner which discloses hand-held finger movement actuated communication devices and systems employing such devices. Penner includes various forms of hand-held communication devices which serve as alternatives to a keyboard and which, in addition, allow the user to receive communications via the sense of touch. The Penner device is adapted for use by persons who are speechless, deaf and speechless, or even blind, deaf and speechless. This provides compact finger movement actuated communication devices for individually responding to thrust and push motions of at least one finger of a person's hand. Thus, each finger can operate two switch elements, and the four fingers of a person's hand can operate eight switch elements in predetermined combinations suitable, for example, for communication in a binary code. In a first disclosed embodiment, a handle-like body supports eight switch actuators arranged as four pairs, with each of the pairs corresponding to a particular finger. The two switch actuators are positioned for selective activation by distal and proximal segments of a single finger. In a second disclosed embodiment, four switch actuators are provided for actuation by the fleshly portions of a person's fingertips. Each of the switch actuators supports two distinct types of movement, pushing and sliding, and operates a pair of switch elements. In a third disclosed embodiment, collar-like rings are worn about the proximal and middle segments of the user's hand. Relative motion between the collar-like rings and a wrist harness is sensed in order to respond to thrust and push motions of the fingers.

Still further glove-type devices exist including U.S. Pat. No. 7,012,593 issued to Yoon et al. which discloses a glove-type data input device and related sensing method. The Yoon et al. device is a data input device shaped into a glove wherein a sensor unit senses the change of a glove shape or a position change by way of the resulting pressure upon a contact surface, and outputs a predetermined sensing signal according to the sensing. An analyzer determines input data by analyzing the sensing signal. An output port outputs the determination result to an external terminal.

As well, U.S. Pat. No. 6,141,643 issued to Harmon discloses a data input glove having conductive finger pads and thumb pad. The Harmon device includes a gloved body with some fingertip portions having conductive fingertip pad elements and operatively connected to an output connector. Also included is a conductive palm pad positioned on a palm portion of the gloved body and operatively connected to an output connector. Contact between any finger pad and the palm pad generates a signal. The signal may be processed by computer processor to provide a desired output, e.g., synthesized speech or other analogue or digital output in a suitable medium. The data glove can be used for inputting data in a covert manner, as well as enabling disabled persons to communicate with the aid of a computer, such as a handheld, wearable, or desktop computer.

Moreover, such glove devices may further be broadened into interactive body suits. For example, U.S. Pat. No. 7,046,151 issued to Dundon discloses an interactive body suit and interactive limb covers. The Dundon device includes firmware, software, oscillating motors, a garment, and peripherals that permit users to interact over the Internet or wireless communications network whereby the sensation of touch is felt by the garment user. The Dundon device consists of an interactive body suit that covers the torso. Peripheral gloves, socks, and adult entertainment attachments for men and women attach to the interactive body suit in appropriate locations. Small oscillating motors embedded in the garment and the peripherals produce a vibrating touch sensation when activated. Each motor has a logic address on the suit or peripheral device that correlates to a logical point on a computer graphic representing the user. Contact with the graphic will generate a command signal that activates a motor in the corresponding area on the suit. In one application, limb covers with embedded oscillating motors are used to provide medical treatment massage therapy.

While each of the above-mentioned devices include tactile modes of sensing and/or communications in one form or another, they each fail to provide for simplified two-way communication in a silent and covert manner. It is, therefore, desirable to provide a solution to inconspicuous communications using tactile communications.

SUMMARY OF THE INVENTION

It is an object of the present invention to obviate or mitigate at least one disadvantage of previous attempts at tactile communication devices.

In a first aspect, the present invention provides a tactile communications system, the system including: a sending unit having a pulse triggering mechanism connected to a transmitter; a receiving unit having a vibration producing mechanism connected to a receiver; and wherein the pulse triggering mechanism is activated by a first user wearing the sending unit to produce a signal received by the receiver to actuate the vibration producing mechanism and thereby produce a tactile response by a second user wearing the receiving unit.

In a further aspect, there is provided a tactile communications sending apparatus, the sending apparatus including: a sending unit formed by a pulse triggering mechanism connected to a transmitter, the sending unit capable of wirelessly communicating with a receiving unit having a vibration producing mechanism connected to a receiver; and wherein the pulse triggering mechanism is activated by a first user wearing the sending unit to produce a signal received by the receiver to actuate the vibration producing mechanism and thereby produce a tactile response by a second user wearing the receiving unit.

In still a further aspect, the present invention provides a tactile communications receiving apparatus, the receiving apparatus including: a receiving unit having a vibration producing mechanism connected to a receiver, the receiving unit capable of wirelessly communicating with a sending unit formed by a pulse triggering mechanism connected to a transmitter; and wherein the pulse triggering mechanism is activated by a first user wearing the sending unit to produce a signal received by the receiver to actuate the vibration producing mechanism and thereby produce a tactile response by a second user wearing the receiving unit.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a system and apparatus for wireless communications directly between a sender and a receiver using a silent pulsating device.

Figure 1:
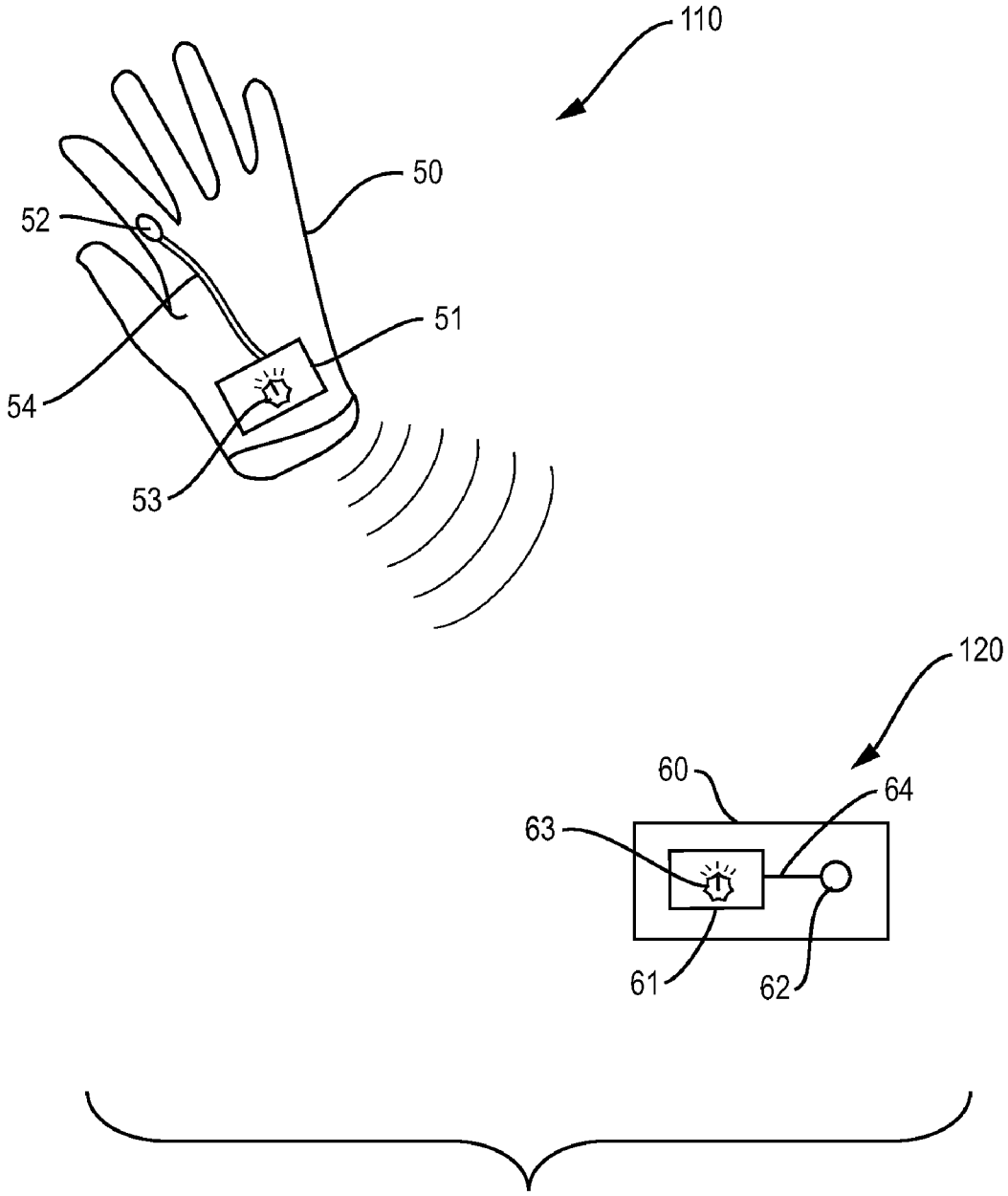
FIG. 1 is a general illustration of the sending unit and receiving unit in accordance with the present invention.

With reference to FIG. 1, the present invention includes a sending unit 110 and a receiving unit 120. As shown, the sending unit 110 is formed as a glove 50 having a pulse triggering mechanism 52. In this way, the sending unit 110 incorporated into the glove 60 is designed to be wearable by a user who is the source of a communications signal. While an embodiment is shown specifically as a glove, it should be understood that the sending unit 110 may be incorporated into any suitable article of clothing worn by the user so long as the user can activate the pulse triggering mechanism 52.

The pulse triggering mechanism 52 may be in the form of a push button, pressure activated switch, motion activated switch, or any similar means by which the user may trigger an electrical signal. In the embodiment as shown, the pulse triggering mechanism 52 is located on the thumb side of the lower index finger. Such location enables the user to activate the pulse triggering mechanism 52 by pressing their thumb against the side of their lower index finger where the pulse triggering mechanism 52 is located. The signal is carried by way of a wire connection 54 to a wireless transmitter 51. The wire connection 54 is preferably embedded in the glove 50. Embedding the wire connection 54 within the glove 50 thus prevents entanglement and excessive wear on the wire itself.

The wireless transmitter 51 preferably includes a channel selector 53 to allow a user wearing the glove 50 to select from a series of possible radio channels over which the signal generated by the pulse triggering mechanism 52 is sent via the wireless transmitter 51. Any suitable radio protocol may be used without straying from the intended scope of the present invention. Moreover, such suitable radio protocol may be non-secured or encrypted in such a manner through additional circuitry and software as would be known by one of ordinary skill in the wireless communications art.

The receiving unit 120 is formed as a patch 60. The patch 60 may be any type of adhesive or removable structure (e.g., a hook and loop material such as Velcro™ which is a product of Velcro, USA Inc., Manchester, N.H.). In this way, the patch 60 is designed to be wearable by a user who is the recipient of the communications signal initiated by the gloved sender. Secured to the patch 60 are a radio receiver 61 and vibration producing mechanism 62. The radio receiver 61 includes a channel selector 63 that, upon proper channel selection, corresponds to the channel selector 53 of the sending unit 51 so as to enable radio communications from the sending unit 51 to the receiving unit 60. The radio receiver 61 is connected via an electrical connection 64 (e.g., a wire or the like) to the vibration producing mechanism 62 so as to produce a silent tactile vibration corresponding to the received communications signal initiated by the gloved sender activating the pulse triggering mechanism 52.

The present invention is intended for use over remote distances. Accordingly, the radio protocols utilized should be of a suitable nature so as to enable appropriate signal strength over distances required for the given application. Such distances may vary and therefore the specific radio hardware and protocol may vary for the transmitter 51 and the receiver 61 without straying from the intended scope of the present invention. The details of such radio hardware and protocols are commonly understood in the communications art and are not therefore described further herein.

From the above description, it should therefore be understood that the user wearing the sending unit 110 is enabled to silently communicate with the remotely located user wearing the receiving unit 120. The process by which the silent communications is accomplished includes a first user tapping a finger so as to activate the pulse triggering mechanism 52 and a second user sensing a corresponding tactile vibration created by the vibration producing mechanism 62. In this manner, a system such as Morse code may be used by the first user to tap out a message such that the second user received and interprets a coded message by the series of long or short tactile sensations. It should be understood that any coding method may be used without straying from the intended scope of the present invention. Indeed, no coding method may be needed if any two users agree upon the meaning of a tactile message.

Figure 2:
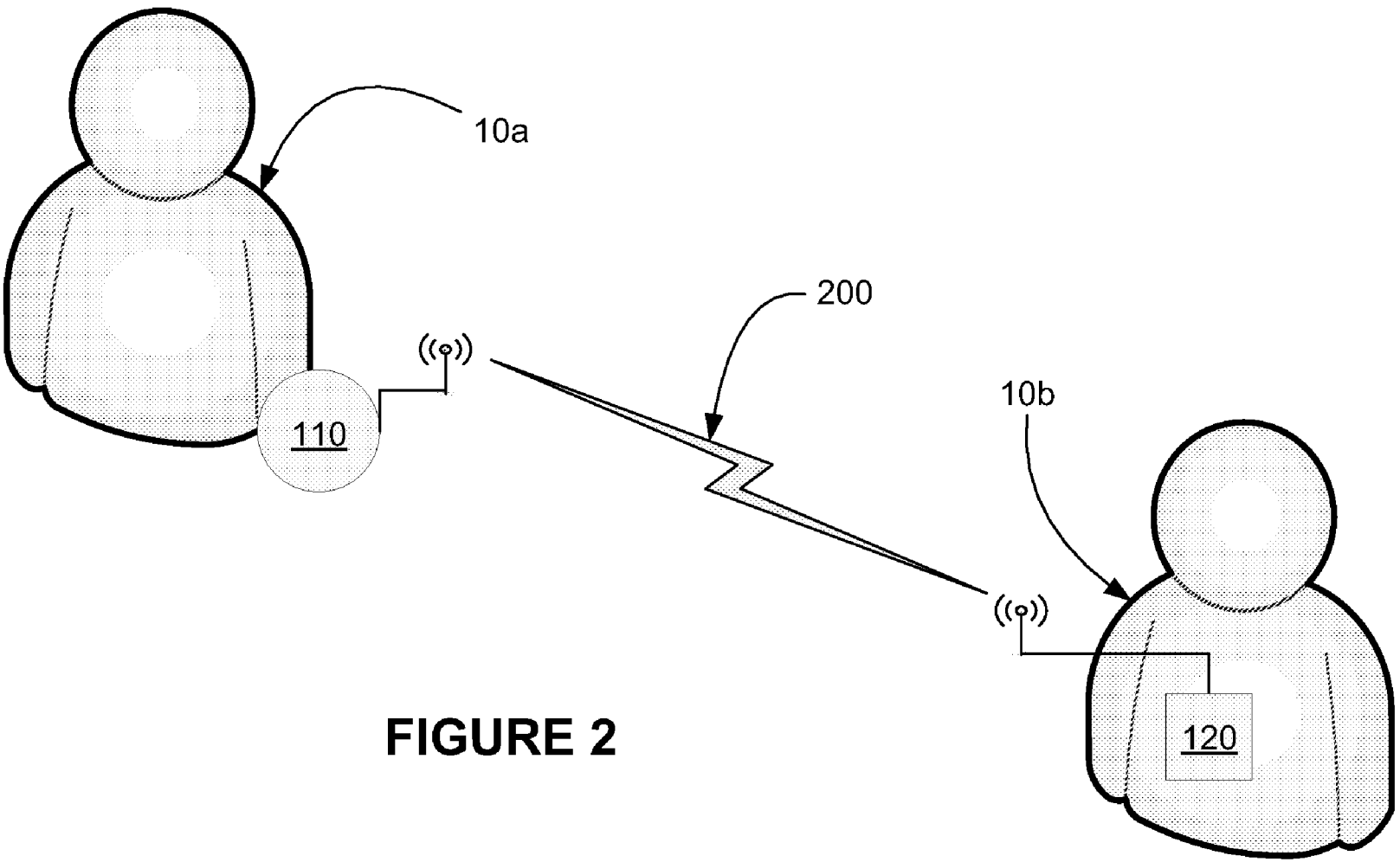
FIG. 2 is a generalized schematic of the sending unit of a first user shown in radio communication with the receiving unit worn by a second user.

In FIG. 2, a generalized schematic of the sending unit 110 of a first user 10*a* is shown in radio communication 200 with the receiving unit 120 worn by a second user 10*b*. Such a configuration may be useful for one-way communications such as, but not limited to, a timed speaking engagement where the first user 10*a* is a moderator and the second user 10*b* is a speaker whose allotted time has ended. In such instance, the first user 10*a* would trigger a tactile signal to inform the second user 10*b* to cease their speech. However, in most instances two-way communications would be a valuable use of the present invention.

Figure 3:
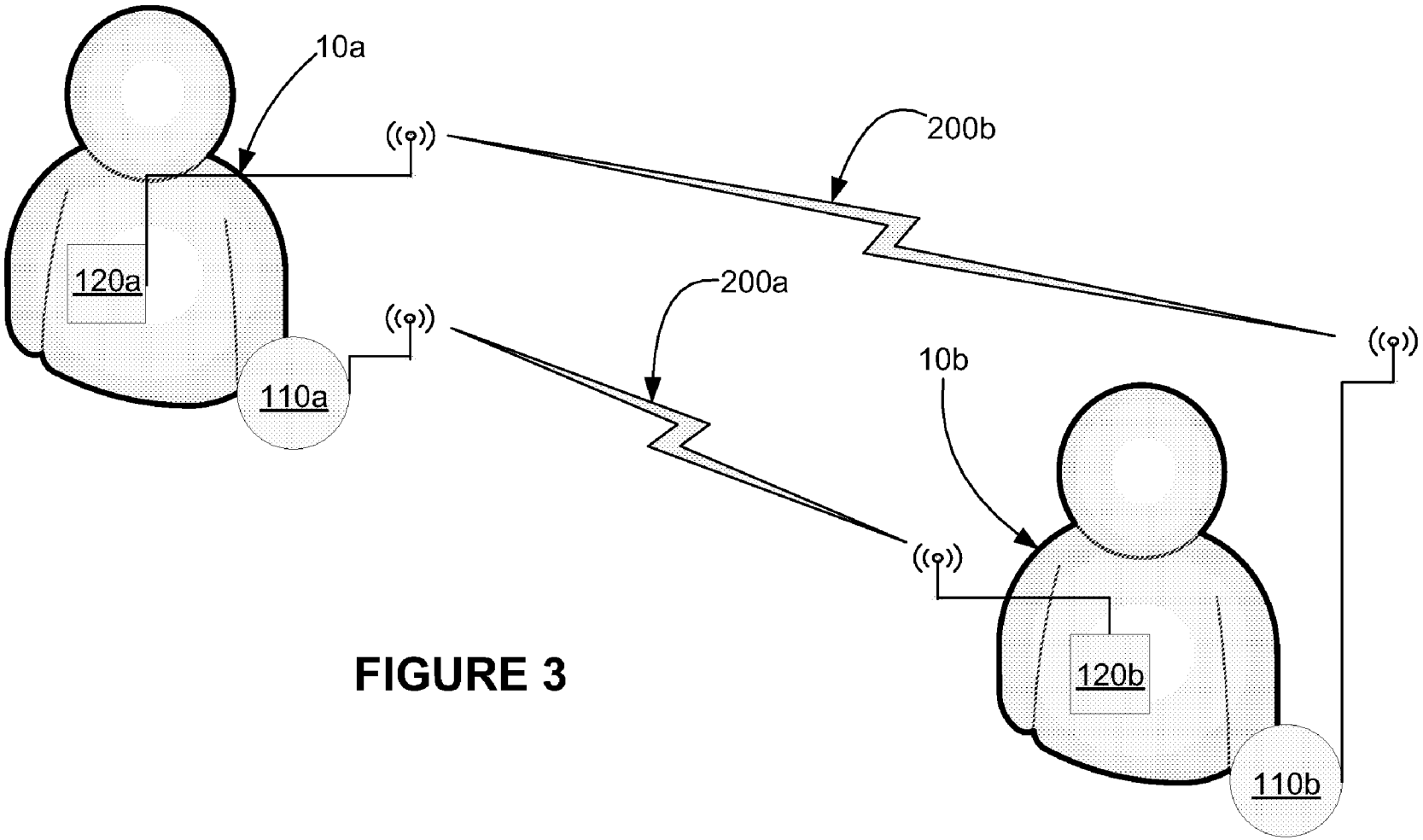
FIG. 3 illustrates a silent two-way communication system similar to that of FIG. 2 but including two sets of sending units and receiving units in accordance with the present invention.

In FIG. 3, silent two-way communication is illustrated generally by a schematic similar to that of FIG. 2. However, in this instance both users include both a sending unit and a receiving unit in accordance with the present invention. Specifically, FIG. 3 shows a first sending unit 110*a* of a first user 10*a* in radio communication 200*a* with a second receiving unit 120*b* worn by a second user 10*b*. Likewise, a second sending unit 110*b* of the second user 10*b* can be seen in radio communication 200*b* with a first receiving unit 120*a* worn by the first user 10*a*. It should be understood that radio channel selection in the two-way mode of communication is important such that the sending unit and receiving unit worn on any given single user are set to different channels.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A tactile communications system, said system comprising:

a sending unit formed by a glove worn on a hand by a first user, said sending unit having a pulse triggering mechanism connected to a transmitter;

a receiving unit formed by a patch worn by a second user on a body part thereof distinct and unrelated to hands of said second user, said receiving unit having a vibration producing mechanism connected to a receiver; said transmitter and said receiver each including a channel selector for selecting a radio channel over which said transmitter and said receiver wirelessly communicate with one another; and wherein said pulse triggering mechanism is activated by said first user wearing said sending unit to produce a radio signal received by said receiver to actuate said vibration producing mechanism and thereby produce a tactile response by a second user wearing said receiving unit.

2. The system as claimed in claim 1 wherein said pulse triggering mechanism is located within a finger portion of said glove, said transmitter is located within a wrist portion of said glove, and a wire for electrically connecting said pulse triggering mechanism to said transmitter is embedded within said glove.

3. The system as claimed in claim 2 wherein said finger portion is a thumb side lower section of an index finger of said glove.

4. The system as claimed in claim 3 wherein said vibration producing mechanism and said receiver connected thereto are both attached to said patch.

5. A tactile communications sending apparatus, said sending apparatus comprising:

a sending unit formed by a pulse triggering mechanism connected to a transmitter, said sending unit integrated within a glove worn on a hand of a first user and capable of wirelessly communicating with a receiving unit having a vibration producing mechanism connected to a receiver, each said transmitter and said receiver including a channel selector for selecting a radio channel over which said transmitter and said receiver communicate; and wherein said pulse triggering mechanism is activated by a first user wearing said sending unit to produce a radio signal received by said receiver to actuate said vibration producing mechanism and thereby produce a tactile response by a second user wearing said receiving unit on a body part thereof distinct and unrelated to hands of said second user.

6. The sending apparatus as claimed in claim 5 wherein a wire for electrically connecting said pulse triggering mechanism to said transmitter is embedded within said article of clothing.

7. The sending apparatus as claimed in claim 6 wherein said pulse triggering mechanism is located within a finger portion of said glove, and said transmitter is located within a wrist portion of said glove.

8. A tactile communications receiving apparatus, said receiving apparatus comprising:

a receiving unit formed by a patch worn by a second user on a body part thereof distinct and unrelated to hands of said second user, said receiving unit having a vibration producing mechanism connected to a receiver, said receiving unit capable of wirelessly communicating with a sending unit formed by a pulse triggering mechanism connected to a transmitter, each said transmitter and said receiver including a channel selector for selecting a radio channel over which said transmitter and said receiver communicate; and wherein said pulse triggering mechanism is integrated within a glove worn on a hand of a first user and activated by said first user wearing said sending unit to produce a radio signal received by said receiver to actuate said vibration producing mechanism and thereby produce a tactile response on said body part of said second user wearing said receiving unit.

9. The sending apparatus as claimed in claim 8 wherein said vibration producing mechanism and said receiver connected thereto are both attached to said patch.

* * * * *